United States Patent [19]

Cronin et al.

[11] Patent Number: 4,978,428

[45] **Date of Patent: * Dec. 18, 1990**

[54] BEARING BLANKET FOR AN EXTENDED NIP PRESS HAVING LAMINATES OF DIFFERENT HARDNESSES

[75] Inventors: Dennis C. Cronin, Rockton, Ill.; David V. Lange, Beloit, Wis.

[73] Assignee: Beloit Corporation, Beloit, Wis.

[ * ] Notice: The portion of the term of this patent subsequent to Mar. 13, 2007 has been disclaimed.

[21] Appl. No.: 450,765

[22] Filed: Dec. 14, 1989

Related U.S. Application Data

[63] Continuation of Ser. No. 854,589, Mar. 14, 1986, Pat. No. 4,908,103.

[30] Foreign Application Priority Data

Oct. 3, 1985 [WO] PCT Int'l Appl. ..... PCT/US85/01953

[51] Int. Cl.[5] ..... D21F 3/02

[52] U.S. Cl. ..... 162/358; 162/DIG. 1; 428/217; 428/423.3

[58] Field of Search ..... 162/358, 360.1, 361; 428/217, 423.3; 100/151, 153

[56] References Cited

U.S. PATENT DOCUMENTS

| | | | |
|---|---|---|---|
| 4,353,296 | 10/1982 | Beucker | 162/358 |
| 4,482,430 | 11/1984 | Majaniemi | 162/358 |
| 4,552,620 | 11/1985 | Adams | 162/358 |
| 4,559,258 | 12/1985 | Kiuchi | 162/358 |
| 4,564,551 | 1/1986 | Best | 162/358 |

*Primary Examiner*—Karen M. Hastings

*Attorney, Agent, or Firm*—Dirk J. Veneman; Raymond W. Campbell; David J. Archer

[57] ABSTRACT

A bearing blanket is disclosed for an extended nip press of a papermaking machine. The blanket (44) includes a base (46) having a first and a second side (48, 50). A first laminate (52) extends along the first side (48) of the base (46), the first laminate (52) having an interface (54) which is disposed contiguous with the first side (48) of the base (46) and a face (56) which cooperates with a hydraulically loaded shoe (22) of the extended nip press (12). A second laminate (58) extends along the second side (50) of the base (46) with the second laminate (58) having a surface (60) which is disposed contiguous with the second side (50) of the base (46). The second laminate (58) defines a plurality of recesses (64, 66) for relieving fluid pressure during passage through the nip. The first laminate has a hardness which permits flexing of the first laminate while the second laminate has a hardness such that crushing of the recesses during passage through the extended nip is inhibited.

1 Claim, 3 Drawing Sheets

FIG. 1
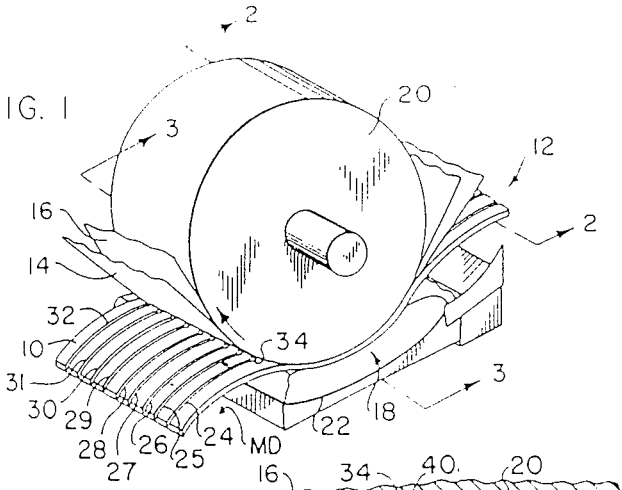
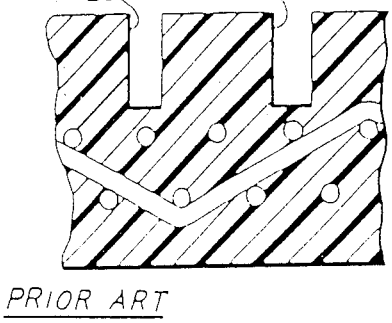
FIG. 2
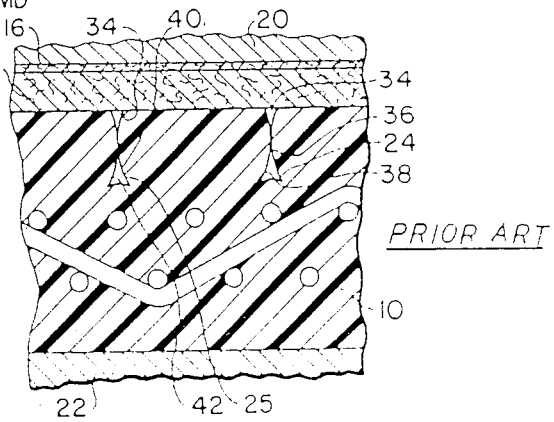
FIG. 3
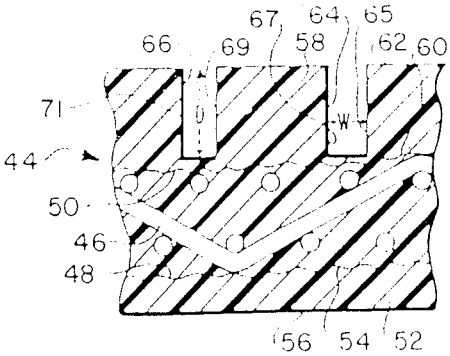
FIG. 4
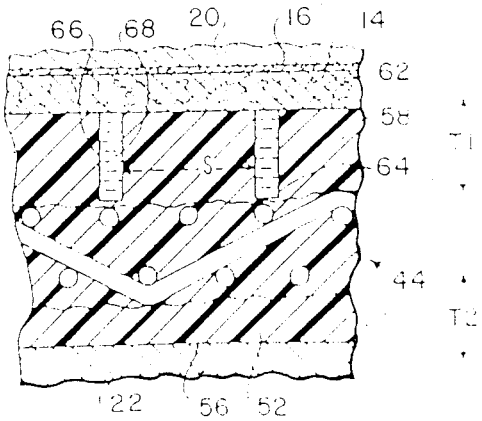
FIG. 5

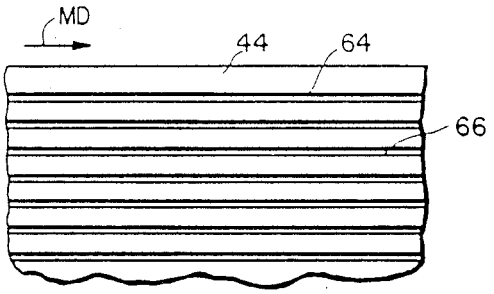
FIG.6
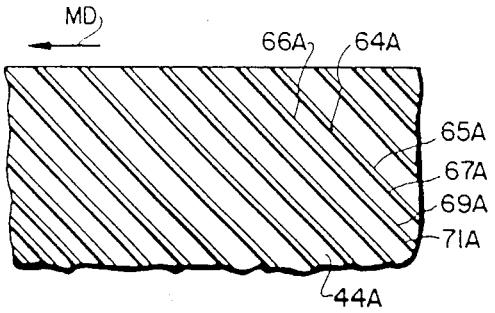
FIG.7
FIG.8
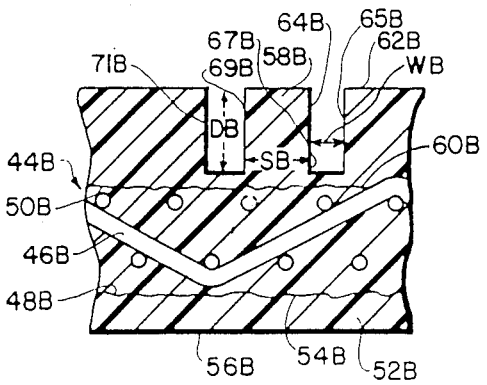

BEARING BLANKET FOR AN EXTENDED NIP PRESS HAVING LAMINATES OF DIFFERENT HARDNESSES

This is a continuation of copending application(s) Ser. No. 06/854/589 filed on Mar. 14, 1986 now U.S. Pat. No. 4,908,103.

BACKGROUND OF THE INVENTION

1. Field of the Invention

This invention relates to a bearing blanket for an extended nip press. More particularly, this invention relates to a bearing blanket for an extended nip press in which the blanket, a felt and a formed web pass through an extended nip defined by a rotatable press roll and a cooperating hydraulically loaded shoe.

2. Information Disclosure Statement

Traditionally, a press section of a papermaking machine has included a pair of counter rotating press rolls defining therebetween a nip for the passage therethrough of a formed web disposed adjacent a felt or between a pair of felts. With such prior art press nips not only is the residence time of the web within the nip very short, but the pressure applied to the formed web is extremely high.

With the advent of the extended nip press, the residence time of the web within the nip is greatly increased and the pressure exerted on the moving web can be significantly reduced. Not only does the extended nip press produce a pressed web which is 5 to 10 percentage points dryer than the corresponding web produced on conventional presses, but such extended nip presses result in the individual fibers within the formed web being pressed closer together thereby resulting in an improved quality in the end product.

The extended nip press includes a bearing blanket, a felt and a formed web which pass through an extended nip defined by a rotatable press roll and a cooperating hydraulically loaded shoe. The hydraulically loaded shoe urges the blanket against the felt during passage through the extended nip such that water is squeezed from the felt and web thus imparting an improved dewatering action.

The pressed web produced by such an extended nip press results in a paper web having 20 percent less water per ton compared with a similar web produced on a conventional press section. Therefore, the energy expended in the dryer section of the papermaking machine is correspondingly reduced. Additionally, production is increased by 25 percent. Furthermore, because of the increased residence time of the formed web in the extended nip, more water is able to migrate from the formed web into the felt.

In practical terms, for every gallon (3.8 liters) of water removed from a moving web in a conventional press section an extra 0.95 liters of water are removed with the extended nip press.

However, in earlier non vented extended nip presses bearing blankets of non vented construction having a continuous looped configuration were utilized. In such solid type blankets, water exuding from the felt during passage of the felt and blanket through the extended nip was unable to flow sufficiently quickly from the extended nip in order to avoid being entrapped between the felt and adjacent blanket during the passage of the web through the extended nip. Water so entrapped not only increased the fluid pressure within the extended nip, but also tended to rewet the formed web.

In an attempt to overcome the aforementioned problem, grooved blankets have been proposed in which a plurality of parallel grooves are formed parallel to the machine direction of the blanket so that water exuding from the felt by the interaction of the felt and blanket is able to flow unimpeded through the multiplicity of grooved channels and thereby inhibit the detrimental buildup of water pressure within the extended nip.

These grooved blankets or blankets having a plurality of recesses for the reception therein of water flowing from the felt have proved only partially successful because although such grooved blankets operate very successfully initially, there exists a tendency for such grooves to be crushed after extended use of the blanket.

The present invention provides a bearing blanket including a woven base and a first and second laminate. The second laminate defines a plurality of parallel grooves and is of urethane having sufficient hardness to inhibit crushing of the grooves while the first laminate is of a lesser hardness for permitting flexing of the second laminate during passage through the extended nip.

In the prior art, a number of patents teach bearing blankets having a plurality of recesses.

U.S. Pat. No. 4,482,430 to Tampella AB describes particularly with reference to FIG. 6 and column 4, lines 27–33, a band 2 having a grooved or blind bored surface layer disposed adjacent to the felt. According to column 4, line 23, the band is fabricated from urethane reinforced with a nylon fabric with water used as the lubricant for the extended nip press. Column 4, lines 20 and 21 describe the urethane elastic material as having a high restoring capability. Column 4, line 30 describes the hardness of the opposite surfaces of the band as being different from each other. No direct reference is made to the need for a particular hardness of the urethane band. However, a surface of the band is claimed and this surface faces the sliding surface of the loading shoe and is provided with "separated recesses for receiving the lubricating medium, said recesses being entirely closed by the sliding surface of said loading shoe when said recesses are within said press zone." Other claims recite various features of the recesses including cup-shaped, rectangular, longitudinal, transverse and oblique grooves or recesses.

U.S. Pat. No. 4,287,021 to Justus teaches an extended nip press and claim 9 discloses a means defining grooves on the inside of the belt with the grooves spiraling towards the center of the belt to move lubricant inwardly along the belt. Additionally, column 3, lines 19–24 define the outer surface of the roll 10 as having grooves therein to aid in the reception of water by the felt 23. More particularly, the outer surface of the belt 25 is similarly grooved to aid in the passage of water from the web into the felt 24. Column 2, lines 23–24 describe the belt as being formed of heavy rubber or reinforced rubber.

Column 2, lines 64–69 describe the belt as being provided with grooves formed on the inner surface thereof as shown by the grooves 42 in the surface 43 of the belt in FIG. 3. This specification states that this tends to work the lubricant towards the center of the belt, with the grooves being relatively shallow so as not to weaken the belt and are preferably disposed in the spiral pattern with the spiral extending towards the center relative to the direction of travel of the inner surface of the belt.

Although such spiral configuration is described as stated hereinbefore, such spiral configuration is not clearly shown in FIG. 3 or any other figures of drawings.

U.S. Pat. No. 4,431,045 to Josephson describes with reference column 3, lines 50–58 a belt for an extended nip press having sufficient hardness to take up and distribute load without excessive deformation while being sufficiently flexible. Polyurethane of durometer hardness in the range of 80 to 85 and approximately ¼" (0.64 cms) in thickness is stated to be useful for some purposes.

Column 2, lines 52–55 teach that the belts may have recesses on the outer side which face the surface of the roll for draining liquid from the pressed web. Alternatively, the belt may have a plurality of apertures for drainage. Furthermore, belt 10 is suitably made of rubber or a flexible plastic. Polyurethane is used in the embodiments of FIGS. 2 and 3.

Column 2, lines 20–28 teach that in the embodiment of FIGS. 2 and 3 a plurality of continuous parallel grooves 92 extend longitudinally on the outer side of the belt for drainage. Alternatively, FIG. 8 illustrates a belt 10.2 having a plurality of apertures 90 or 96 for drainage. As shown in FIG. 9, apertures 94 extend completely through the belt. Alternatively, as seen in FIG. 10, blind-drilled apertures 96 may be used.

U.S. Pat. No. 4,492,611 to Meinandor teaches in Column 2, line 16, an endless water impervious belt 4 and 5 for use in conjunction with an extended nip press.

U.S. Pat. No. 4,496,429 to Salminen assigned to Tampella teaches an endless band running around two band rolls of an extended nip press. Column 2, lines 51–53 teach drillings 10 as shown in FIG. 5 or holes or grooves for receiving water from the felt in the press surface of the V-bands or V-belts.

U.S. Pat. No. 4,503,765 to Voith discloses at Column 3, lines 34–40 a pressure belt 21 as being impermeable to liquid and is "lubricated with oil on its inner surface by means of devices not illustrated."

U.S. Pat. No. 4,425,190 to Cronin describes an extended nip press including a belt generally designated "compliant transport systems." This specification does not include details as to whether the belt is grooved in any way and the main thrust of the specification resides in the concept of introducing the belt 32 over lubricant reservoir 40 prior to coming into contact with the lower felt 30 and subsequent passage through the extended nip.

U.S. Pat. No. 4,427,492 to Cronin discloses an extended nip press having a compliant belt 32. This specification makes no mention of such belt 32 as being grooved and no reference is made to the belt being fabricated from urethane. Column 4, lines 61–69 teach the compliant belt 32 as being 0.3" (0.76 cm) thick in the non-compressed state with belt 32 compressing to 0.29" (0.74 cm).

Column 5, lines 25–30 teaches that belt 32 distorts sideways during movement along the nip shoe compliant belt interface and that this sideways distortion brings the compliant belt 32 to the side edges 58 of the nip shoe 24.

U.S. Pat. No. 4,428,797 to Cronin teaches at column 4, line 63 the belt 32 as being compressed to 0.29" (0.74 cm).

U.S. Pat. No. 3,775,243 to McCarrick teaches at column 2, lines 12–13 a granite press roll 13 having a grooved surface 16 as shown in FIG. 2.

U.S. Pat. No. 4,459,907 to Sundman teaches a belt for moving water from a moving layer of peat. The belt includes a plurality of recesses or compression chambers 9 of truncated pyramid configuration as shown in FIG. 2.

U.S. Pat. No. 4,353,296 to Beucker discloses a rubber covered nip roll in which an elastomer cover is grooved circumferentially and in which the modulus of elasticity of the cover is greater in a transverse direction than in the circumferential direction in order to prevent or reduce closing up of the grooves during passage through the nip area.

U.S. Pat. No. 4,330,023 to Cronin teaches a belt 216 of an extended nip press in which lateral edges of the belt are disposed outside the pressure shoe area.

British Patent No. 2,106,555A to Albany International Corporation describes a belt of an extended nip press in which the belt includes a base fabric 20, as shown in FIG. 3. The fabric 20 is impregnated with polyurethane 22. The specification does not disclose a grooved belt or the hardness of the polyurethane coating.

British Patent No. 2,106,557A to Albany International Corporation teaches a belt 16 for an extended nip press and lines 124–129 teach that the belt 16 comprises a two layer woven monofilament base fabric 20 which has multifilament or spun stuffer yarns 21 impregnated on one face with a polymeric material 22 such as polyurethane. This specification does not disclose a grooved belt or differential hardness of polyurethane.

EPO Patent No. 138,797 to Yamauchi Rubber Industries, Ltd. teaches an endless belt for an extended nip press in which the yarns in the direction transversely across the belt running direction do not need a high strength. This specification makes reference to the two aforementioned British Albany patents. No reference is made to grooved belts or the hardness of the polyurethane coating.

U.S. Pat. No. 4,364,421 to Martin describes a dryer fabric of woven construction including means for joining the respective ends of the felt together to form a continuous loop.

U.S. Pat. No. 4,221,373 to Muller is marginally relevant in that the specification describes an endless belt 13 shown in FIG. 3 as being provided with a V-shaped groove 17 along the length thereof.

British Patent No. 2,142,946A in the name of Osakeyhito describes an extended nip press including a loaded, stiff, endless flexible belt.

British Patent No. 2,127,449A to Bergstrom teaches on page 2, lines 66–68 a traveling belt 25 which is of strong material, such as reinforced rubber used in extended nip presses. No disclosure is made of the grooved belt and no details as to hardness are taught in the specification.

Canadian No. 1,068,525 to Schmitt and Rempel is marginally relevant in disclosing a belt 16*a* and 21*a* for an extended nip press as shown in FIG. 1. Another embodiment shown in FIG. 2 teaches a belt 116*a* and 121*a*, respectively. No details as to construction of such belts is made or any reference to such belts being grooved.

French No. 2,153,218 to Scaal teaches on page 2, lines 7–12 a belt 2*a* of urethane material.

U.S. Pat. No. 4,483,745 to Wicks et al teaches an extended nip press having an endless traveling impervious belt 15, the hardness of which is in the range 10 to 200 P and J. This specification does not disclose such belt 15, 40 or 60 according to the various embodiments of the invention as being grooved.

U.S. Pat. No. 4,353,828 to Weyerhaeuser teaches a dryer for a papermaking machine including a fabric and cylinder combination Column 4, lines 13–16 teach that the fabric may include circumferential grooves.

U.S. Pat. No. 4,359,827 to Weyerhaeuser discloses in Column 13, lines 60–67 that the dryer fabric may alternatively include circumferential grooves and the fabric must be permeable in order for the vacuum to communicate through the fabric and hold the web or sheet to it.

EPO No. 117,212 to Allan Angogna shows with reference to FIG. 5, a roll having grooves 22, 23 and 24 described on pages 8, lines 25–27.

EPO No. 107,607 to Justus teaches an extended nip press having a belt B. However, no details are given as to the composition of the belt or hardness thereof. No disclosure is made as to whether the belt is grooved or not.

EPO No. 109,220 to Arav relates to a hydraulic control system for an extended nip press. No details are given as to the blanket or whether the blanket is grooved or not.

EPO No. 64,933 to Justus discloses an extended nip press having impervious belts 16 and 17 sandwiching the felt and web therebetween. The belts are not disclosed as being grooved, but the traction rolls 20 and 22 are grooved.

None of the aforementioned prior art disclose a blanket having a first and second laminate having differential hardness relative to each other for inhibiting crushing of the venting or drainage grooves. Therefore, it is a primary objective of the present invention to provide a bearing blanket for an extended nip press having improvements which overcome the inadequacies of the prior art proposals and which provides a significant contribution to the papermaking art.

Another objective of the present invention is the provision of a bearing blanket for an extended nip press in which the blanket includes a first laminate which cooperates with the shoe, and a second laminate defining a plurality of grooves, the first and second laminates having a hardness differential relative to each other which permits flexing of the first laminate and inhibits crushing of the grooves during passage of the blanket through the extended nip.

Another object of the present invention is the provision of a bearing blanket in which the first laminate has a hardness within the range 80 to 93 Shore "A", thereby permitting the laminate to flex during passage through the extended nip.

Another object of the present invention is the provision of a bearing blanket in which the second laminate has a hardness of at least 94 Shore "A", thereby inhibiting crushing of the plurality of recesses during passage of the blanket through the extended nip so that fluid flow from the felt is unimpeded.

Another object of the present invention is the provision of a bearing blanket in which the second laminate has a thickness which is greater than the thickness of the first laminate, thereby having sufficient thickness to accommodate a plurality of parallel grooved recesses therein.

Another object of the present invention is the provision of a bearing blanket in which the second laminate has a hardness of at least 99 Shore "A" to inhibit crushing of the plurality of grooves.

Other objects of the present invention will be apparent to those skilled in the art and from the detailed description taken in conjunction with the accompanying drawings, and it will be appreciated by those skilled in the art that the present invention is equally applicable to extended nip presses utilizing two felts and using any combination of plain, vented or grooved rolls.

SUMMARY OF THE INVENTION

This invention relates to a bearing blanket of an extended nip press in which the blanket, a felt and a formed web pass through an extended nip defined by a rotatable press roll and a cooperating hydraulically loaded shoe. The blanket includes a base for imparting inherent rigidity to the blanket, the base having a first and a second side. A first laminate extends along the first side of the base with the first laminate having an interface disposed contiguous with the first side of the base, and a face which cooperates with the hydraulically loaded shoe of the extended nip press. A second laminate extends along the second side of the base with the second laminate having a surface which is disposed contiguous with the second side of the base. The second laminate defines a boundary such that the boundary cooperates with the felt of the extended nip press. The second laminate defines a plurality of recesses extending from the boundary towards the base for channeling fluid flow from the felt during passage of the blanket, felt and web through the extended nip. The laminates have a differential hardness relative to each other with the first laminate having a hardness which permits flexing of the first laminate during passage through the extended nip. The second laminate has a hardness such that crushing of the recesses during the passage through the extended nip is inhibited so that the fluid flow is unimpeded.

In a more particular embodiment of the present invention, the base is a woven textile fabric and the first laminate is a urethane coating applied to the first side of the woven base. The first laminate has a hardness within the range of 80 to 93 Shore "A."

The second laminate is a urethane coating applied to the second side of the woven base with the second laminate having a hardness of at least 94 Shore "A." The second laminate has a thickness which is greater than the thickness of the first laminate.

The plurality of recesses are a plurality of grooves with each groove being spaced and parallel relative to each other. The grooves extend parallel to the machine direction of the blanket.

In an alternative embodiment of the present invention, the grooves extend obliquely relative to the machine direction of the blanket. In either embodiment of the present invention as described hereinbefore, each groove of the plurality of grooves has a depth which is greater than the width of the groove, and each groove has a depth which is less than the thickness of the second laminate. In both embodiments, the grooves are spaced apart by a distance which is greater than the depth of the groove.

In another embodiment of the present invention, the grooves are spaced apart by a distance which is less than the depth of the grooves.

In a preferred embodiment of the present invention, the first laminate has a hardness within the range 80 to 93 Shore "A" and the second laminate has a hardness of at least 99 Shore "A" in order to permit flexing of the first laminate while inhibiting crushing of the plurality of recesses.

The present invention is not limited by the detailed description of the embodiments disclosed hereinafter taken in conjunction with the accompanying drawings. Various modifications to the inventive concept are included within the scope of the appended claims, and such modifications and variations are included within the spirit and scope of the present invention as defined by the appended claims.

BRIEF DESCRIPTION OF THE DRAWINGS

FIG. 1 is a perspective view of an extended nip press having a single felt and a bearing blanket;

FIG. 2 is a sectional view taken on the line 2—2 of FIG. 1 showing a portion of a conventional blanket including longitudinal grooves;

FIG. 3 is a sectional view taken on the line 3—3 of FIG. 1 showing a portion of the blanket as shown in FIG. 2, but with the blanket being compressed between the rotatable press roll and the loaded shoe;

FIG. 4 is a sectional view similarly to that shown in FIG. 2, but showing a bearing blanket constructed according to the present invention;

FIG. 5 is a similar view to that shown in FIG. 3, but shows the blanket of FIG. 4 under compression between the roll and the shoe, and with the grooves maintaining their fluid conducting capability;

FIG. 6 is a top plan view of a portion of the blanket according to one embodiment of the present invention showing the grooves disposed parallel to the machine direction of the blanket;

FIG. 7 is a plan view of an alternative embodiment of the present invention in which the grooves are disposed obliquely relative to the machine direction of the blanket;

FIG. 8 is a sectional view of an alternative blanket showing the grooves spaced apart by a distance which is less than the depth of the grooves.

Similar reference characters refer to similar parts throughout the various embodiments of the present invention.

DETAILED DESCRIPTION

Figure 9:
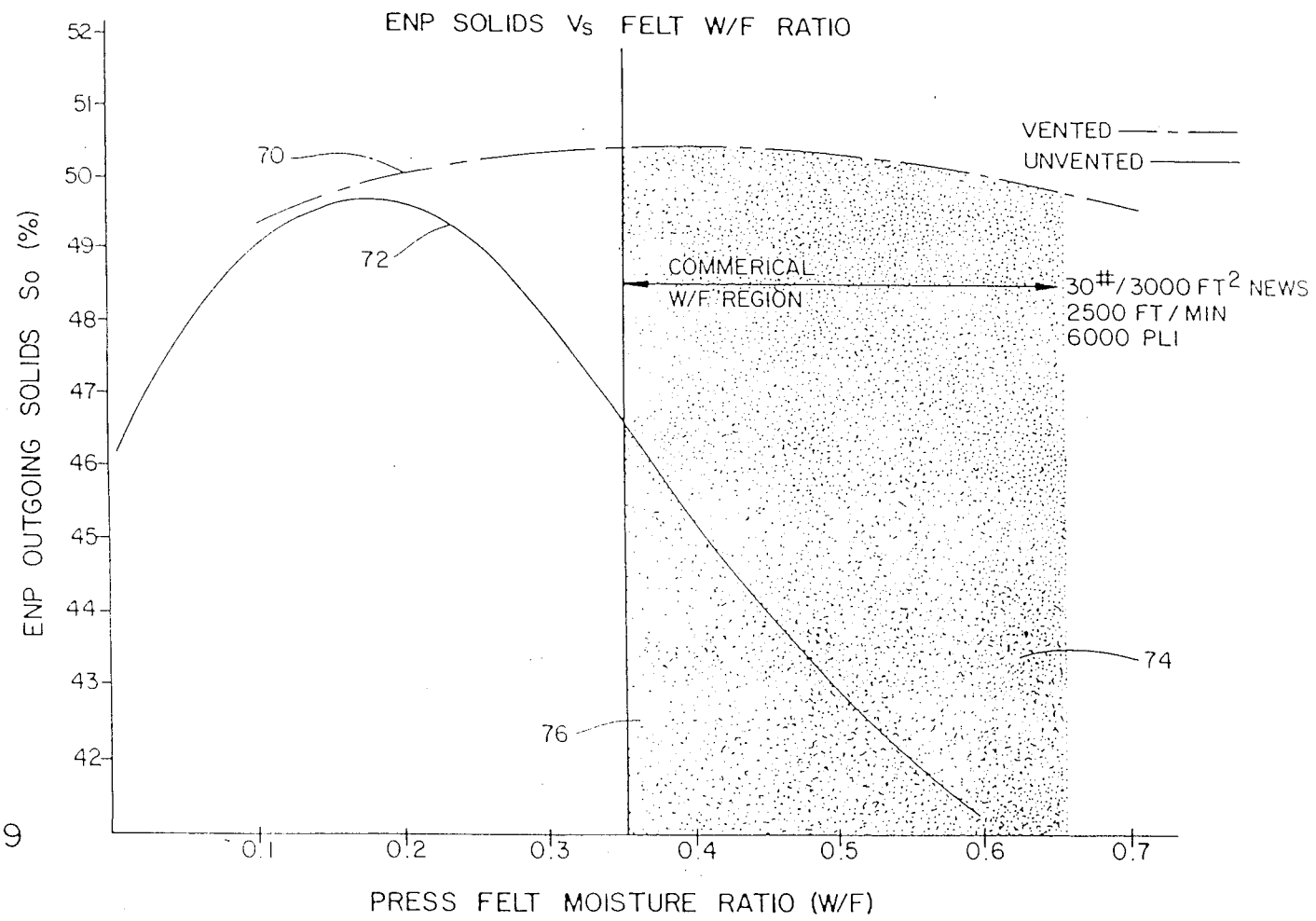
FIG. 9 is a graph of ENP solids removal against felt water to fiber ratio with the graph comparing the vented blanket with an unvented blanket.

FIG. 1 is a perspective view of a bearing blanket 10 for an extended nip press generally designated 12 in which the blanket 10 and a felt 14 and a formed web 16 pass through an extended nip indicated generally as 18 defined by a rotatable press roll 20 and a cooperating hydraulically loaded shoe 22.

As shown in FIG. 1, the blanket 10 includes, a plurality of grooves 24, 25, 26, 27, 28, 29, 30, 31, and 32 with the grooves 24 to 32 being spaced and parallel relative to each other and being parallel to the machine direction of the blanket 10 as indicated by the arrow MD in FIG. 1. Although FIG. 1 shows nine grooves 24 to 32, it will be apparent to those skilled in the art that a typical blanket according to the present invention will define several hundred grooves and that the nine grooves are shown for clarity. As the blanket 10, felt 14, and formed web 16 pass through the extended nip 18, water 34 is removed from the formed web 16 and is absorbed by the felt 14. This water 34 is exuded into the plurality of grooves 24 to 32, by the interaction of the roll 20 and shoe 22 (as shown in FIG. 1).

FIG. 2 is a sectional view taken on the line 2—2 of FIG. 1 and shows a portion of a conventional bearing blanket 10 with the blanket 10 being uncompressed. The blanket 10 of FIG. 2 shows two grooves 24 and 25 for the reception and channeling of water 34 removed from the felt 14.

FIG. 3 is a sectional view taken on the line 3—3 of FIG. 1 and shows the conventional blanket 10 being compressed between the press roll 20 and the shoe 22. In a typical extended nip press, the pressure exerted by the shoe 22 on the press roll 20 will be approximately 800 lbs. per square inch. When the bearing blanket 10 is thus compressed as shown in FIG. 3, the grooves 24 and 25 close up with the first and second walls 36 and 38 of the groove 24 and the first and second wall 40 and 42 of the groove 25 bulging towards each other so that the walls 36 and 38 and the walls 40 and 42 touch each other thereby drastically reducing the ability of the grooves 24 and 25 to convey water 34 from the felt 14. Not only does such absence of water removal result in a wetter web 16 emanating from the extended nip 18, but such water 34 creates an increased pressure in the felt 14 and the formed web 16 which has a detrimental effect on the resultant web.

FIG. 4 shows a bearing blanket generally designated 44 according to the present invention which overcomes the aforementioned problem. The blanket 44 includes a woven base 46 for imparting inherent rigidity to the blanket 44. The base 46 includes a first and a second side 48 and 50, respectively. A first laminate 52 extends along the first side 48 of the base 46. The first laminate 52 has an interface 54 disposed contiguous with the first side 48 of the base 46, and a face 56 of the first laminate 52 cooperates with the hydraulically loaded shoe 22 of the extended nip press 12 as shown in FIG. 5. A second laminate 58 extends along the second side 50 of the base 46 with the second laminate 58 having a surface 60 disposed contiguous with the second side 50 of the base 46. The second laminate 58 defines a boundary 62 such that the boundary 62 cooperates with the felt 14 of the extended nip press 12. The second laminate 58 defines a plurality of recesses 64 and 66 which extend from the boundary 62 towards the base 46 for channeling fluid flow 68 as shown in FIG. 5 from the felt 14 during passage of the blanket 44, felt 14, and web 16 through the extended nip.

The laminates 52 and 58 have a hardness differential relative to each other with the first laminate 52 having a hardness which permits flexing of the first laminate 52 during passage through and around the extended nip 18 and around ancillary rolls or the like (not shown). The second laminate 58 has a hardness such that crushing of the recesses 64 and 66 during passage through the extended nip 18 is inhibited so that the fluid flow 68 is unimpeded.

More particularly, the woven base 46 is a woven textile fabric and the first laminate 52 is a urethane coating applied to the first side 48 of the woven base 46.

In a preferred embodiment of the present invention, the first laminate has a hardness within the range 80 to 93 Shore "A".

The second laminate 58 is a urethane coating applied to the second side 50 of the woven base 46. In a preferred embodiment of the present invention, the second laminate 58 has a hardness of at least 94 Shore "A" and preferably has a Shore "A" hardness of 99 or more. The second laminate 58 as shown in FIGS. 4 and 5, has a thickness T1 which is greater than the thickness T2 of the first laminate 52.

However, the laminates 52 and 58 may have the same thickness as each other or the first laminate 52 may be thicker than the second laminate 58.

In a preferred embodiment of the present invention, as shown in FIGS. 4 and 5, the plurality of recesses 64 and 66 are a plurality of grooves with each groove being spaced and parallel relative to each other as shown in FIG. 6. FIG. 6 shows the grooves 64 and 66 extending parallel to the machine direction MD of the blanket 44. The groove 64 as shown in FIG. 4 includes a first and second wall 65 and 67 respectively and the groove 66 includes a first and second wall 69 and 71 respectively.

In another embodiment of the present invention as shown in FIG. 7, the grooves 64A and 66A extend parallel relative to each other, but obliquely relative to the machine direction MD of a blanket 44A.

The grooves 64A and 66A have a first and second wall 65A, 67A, 69A and 71A respectively as shown in FIG. 7.

In both the embodiments of FIGS. 6 and 7, each of the grooves 64, 66, 64A and 66A, has a depth D which is greater than the width W of the grooves Each groove of the plurality of grooves has a depth D which is less than the thickness T1 of the second laminate 58. Each groove of the plurality of grooves is spaced apart by a distance S which is greater than the depth D of the groove as shown in FIG. 5.

In a particular embodiment of the present invention, the distance S is between 3–6 times the width W.

As shown in FIG. 8, a further embodiment of the present invention includes a blanket shown in section. The blanket includes grooves 64B and 66B. The grooves 64B and 66B are spaced apart by a distance SB which is less than the depth DB of the grooves 64B and 66B.

FIG. 9 is a graph showing the extended nip press outgoing solid percentage, that is the percentage of water removed from the formed web after transit through the extended nip press. This outgoing solids indication is shown against the press felt moisture ratio. The graph shown in dotted line and labeled 70 indicates figures obtained relative to a vented extended nip press whereas the solid line 72 of the graph indicates the results obtained from an extended nip press in which the blanket is unvented. The portion 74 under the graph 70 and the portion 76 under the graph 72 are shown as shaded portions and indicate a commercially viable felt moisture ratio region. From the graph of FIG. 8, it will be readily apparent to those skilled in the art that the vented blanket provides a significant improvement relative to the unvented counterpart and that it is therefore essential that the grooves of the blanket be prevented from collapsing under load and/or extended use of the blanket.

In operation of the bearing blanket 44, according to the present invention, when the blanket 44, felt 14 and formed web 16 pass between the press roll 20 and the shoe 22, as shown in FIG. 1, the hydraulic pressure applied by the shoe 22 squeezes water from the formed web 16. As the blanket, felt and web 44, 14, and 16, respectively continue through the extended nip 18, water is retained in the felt until the felt becomes saturated and the continued application of pressure by the shoe 22 presses the blanket 44 against the felt 14 thereby exuding water from the felt 14 at the interface 54 of the felt 14 and the blanket 44. The exuded water 34 flows into the plurality of recesses 64, 66 or 64A and 66A and is able, according to the present invention, to flow generally in the machine direction MD of the blanket to be retrieved by a saveall (not shown). According to the present invention, the first laminate 52 has a relatively low Shore "A" hardness thereby enabling the blanket 44 to flex during passage around the shoe 22 and various backing rollers (not shown). However, the second laminate 58 has a greater hardness than the first laminate 52 and is, therefore, able to resist lateral crushing of the walls 65, 67, 69 and 71 or 65A, 67A, 69A and 71A due to the pressure exerted between the shoe and the roll 22 and 20, respectively. Because of the hardness of the second laminate 58, water exuded from the felt 14 is able to flow freely away from the extended nip 18.

EXAMPLE 1

In a particular grooved blanket according to the present invention, each groove had a width of 0.61 millimeters, a grooved depth of 1.9 millimeters and groove centers of 2.54 millimeters. The urethane hardness of the second laminate was 99 Shore "A". The particular extended nip press used was set up for a blanket 762 millimeters in the cross-direction and 7,620 millimeters in the machine direction.

The grooves of this sample blanket did not close up under compression as much as those of the softer samples. The sample was compressed for 24 hours at 800 lbs. per square inch and then retested. The flow data indicated that the grooves close slightly though only reducing the flow by ten percent.

The blanket was fabricated with a width of 1,600 millimeters with the hard and the soft urethanes disposed on either side of the woven base, and the blanket was then divided longitudinally into two pieces.

The sample of Example 1 proved to be very successful and currently continues to run without any problems, and has had a total running time of at least 300 hours.

In the example, as stated hereinbefore, the samples were tested for urethane hardness using a Shore "A" durometer and a Pusey and Jones (P&J) plastometer. The sample was tested for water flow through the grooves, while under Z direction compression using the test apparatus which included an orifice block used to admit water at 5 lbs. per square inch, the block measured 2.5"×2.5" (6.35 cms.×6.35 cms.) with a 1" (2.54 cm.) diameter reamed hole in the center. A hydraulic press was used to load the orifice block against the blanket sample and the water flow through the 1"(2.54 cm.) hole and out the grooves was measured.

As shown in FIG. 5, the improved blanket 44 and 44A, according to the present invention, firstly enables water to be effectively removed from the felt during passage through an extended nip, thereby reducing the rewetting of the felt and formed web. Secondly, the blanket of the present invention inhibits the buildup of hydraulic pressure between the shoe and press roll resulting from the inability of water to flow from the extended nip.

Other advantages and features of the present invention will be readily apparent to those skilled in the art and should be construed as being included within the spirit and scope of the present invention as defined by the appended claims.

What is claimed is:

1. A bearing blanket (44) for use in an extended nip press (12) in which the blanket (44) and felt (14) and a formed web (16) pass through an extended nip (18) defined by a rotatable press roll (20) and a cooperating hydraulically-loaded shoe (22), said blanket (44) comprising in combination:

a base (46) for imparting inherent rigidity to the blanket (44), said base (46) having a first and a second side (48,50);

a first laminate (52) extending along said first side (48) of said base (46), said first laminate (52) having an interface (54) disposed contiguous with said first side (48) of said base (46) and a face (56) which cooperates with the hydraulically-loaded shoe (22) of the extended nip press (12);

a second laminate (58) extending along said second side (50) of said base (46), said second laminate (58) defining a boundary (62) such that said boundary (62) cooperates with the felt (14) of the extended nip press (12), said second laminate (58) defining a plurality of recesses (64,66) extending from said boundary (62) toward said base (46) for channeling fluid flow (68) from the felt (14) during passage of the blanket (44), felt (14) and web (16) through the extended nip (18); and said laminates (52,58) having a hardness differential relative to each other, said first laminate (52) having a hardness within the range 80–93 Shore "A" for permitting flexing of said first laminate (52) during said passage through said extended nip (18), said second laminate (58) having a hardness of at least 94 Shore "A" such that crushing of said recesses (64,66) during said passage through said extended nip (18) is inhibited so that said fluid flow (68) is unimpeded.

* * * * *